US005203660A

United States Patent [19]

Takahiro

[11] Patent Number: 5,203,660

[45] Date of Patent: Apr. 20, 1993

[54] MULTISTORY PARKING SPACE

[75] Inventor: Tsubota Takahiro, Hyogo, Japan

[73] Assignee: Takenaka Corporation, Osaka, Japan; a part interest

[21] Appl. No.: 933,895

[22] Filed: Aug. 24, 1992

Related U.S. Application Data

[63] Continuation of Ser. No. 561,712, Aug. 1, 1990, abandoned.

[51] Int. Cl.[5] ..... E04H 6/00

[52] U.S. Cl. ..... 414/257; 414/252; 414/253; 414/259; 414/239; 414/233; 414/261

[58] Field of Search ..... 414/227, 231, 232, 233, 414/234, 236, 237, 239, 240, 241, 252, 253, 257, 259, 260, 261, 262, 242, 244, 245, 246; 52/174

[56] References Cited

U.S. PATENT DOCUMENTS

| | | | |
|---|---|---|---|
| 1,486,275 | 3/1924 | Becker | 414/257 X |
| 1,567,346 | 12/1925 | Tunison et al. | 414/259 X |
| 1,864,711 | 6/1932 | Buettell | 414/252 X |
| 1,896,021 | 1/1933 | Taylor | 414/227 |
| 1,969,002 | 8/1934 | Gleidmann | 414/257 |
| 2,223,962 | 12/1940 | Mitchell | 414/260 X |
| 2,714,456 | 8/1955 | Manaugh | 414/253 |
| 2,779,484 | 1/1957 | Schramm et al. | 414/260 X |
| 2,873,865 | 2/1959 | Inglis | 414/237 |
| 3,040,913 | 6/1962 | Foster, Jr. et al. | 414/236 |
| 3,171,551 | 3/1965 | Stirling | 414/252 |

FOREIGN PATENT DOCUMENTS

| | | | |
|---|---|---|---|
| 243692 | 3/1965 | Austria | 414/239 |
| 666699 | 5/1929 | France | 414/257 |
| 9274 | 1/1977 | Japan | 414/233 |
| 272867 | 11/1988 | Japan . | |
| 308163 | 12/1988 | Japan . | |
| 150764 | 4/1989 | Japan . | |
| 74769 | 3/1990 | Japan . | |
| 74770 | 3/1990 | Japan . | |
| 108769 | 4/1990 | Japan . | |
| 848942 | 9/1960 | United Kingdom | 414/237 |

*Primary Examiner*—Frank E. Werner

*Attorney, Agent, or Firm*—Kerkam, Stowell, Kondracki & Clarke

[57] ABSTRACT

A multistory parking space that is provided with an entrance and exit area, an elevator, power carriers and parking pallets. A vehicle in the entrance and exit area is transported by the elevator to the power carriers, and then the vehicle is transported to the parking pallets by the power carrier. All of these elements are provided with conveyors for transferring a vehicle. Entrance and exit of vehicles to and from the entrance and exit area, vertical travelling of the elevator, travelling of the power carrier are executed simultaneously to shorten the time required for entrance and exit.

3 Claims, 5 Drawing Sheets

MULTISORY PARKING SPACE

This is a continuation of application Ser. No. 07/561,712, filed Aug. 1, 1990, now abandoned.

FIELD OF THE INVENTION

The present invention relates to improvement of mechanical transportation type multistory parking spaces, and in particular, to shortening of the waiting time required for entrance to and exit from such parking spaces.

PRIOR ART

In many of the conventional multistory parking spaces entrance and exit of vehicles are completely effected by self-run thereof. In some multistory parking spaces vehicles are transferred between the entrance and s exit floor and the parking floors by means of an elevator, and on the parking floor the vehicles are transferred by self-run. All of these multistory parking spaces have problems such as that a wide parking area is required to provide a self-run space for the vehicles, that the parking floor must be provided with safety facilities including emergency escape facilities since passengers have to enter the parking floor, and that exhaust gas from the vehicles gives damage to the surrounding environment.

To solve such problems, the present inventor proposed mechanical transportation type multistory parking spaces that combine three factors; vertical transport of vehicles by means of an elevator, power carriers, and parking pallets (for example, Unexamined Japanese Patent Publication SHO-63-272,867, Unexamined Japanese Patent Publication SHO-63-308,163, and Unexamined Japanese Patent Publication SHO-64-75,308).

A key to the successful operation of a large-scale multistory parking space is to shorten the time required for entrance and exit of vehicles. A multistory parking space can not work properly if it has to keep its user to wait for a long time.

SUMMARY OF THE INVENTION

One object of the present invention is to shorten the waiting time required of a vehicle for entrance to and exit from a multistory parking space.

Another object of the present invention is to enhance the safety of the multistory parking space.

The multistory parking space according to the present invention is characterized in that the multistory parking space is provided with at least an elevator for transporting a vehicle, and a power carrier for transporting vehicles between the elevator and the parking positions on the parking floor, that the multistory parking space is provided with, other than the elevator, at least one entrance and exit area for transferring a vehicle to or from the elevator, and that the entrance and exit area, elevator and power carriers are all provided with vehicle transferring means for transferring a vehicle by shifting motion.

With this arrangement, a passenger is allowed to run a vehicle by self-propulsion to the entrance and exit area and leave the vehicle therein. Even when the following entrance operation takes time, the passenger may leave the parking space without being bothered by the entrance operation. Furthermore, as the passenger is not required to drive the vehicle into the elevator, the safety is enhanced. In a similar manner, at the time of exit, the passenger is not required to get into the vehicle inside the elevator. It is sufficient for the passenger to wait for the vehicle being shifted from the elevator to the entrance and exit area and get into the vehicle. As a result, the need of starting the vehicle inside the elevator is eliminated, resulting in an enhanced safety.

The multistory parking space is preferably provided with means for simultaneously effecting, during continuous entrance and exit of vehicles, three kinds of operations; entrance and exit operation of vehicles to and from the entrance and exit area, vertical travelling operation of the elevator, and travelling operation of carriers.

The present inventor found that, in the operations of this kind of multistory parking space, self-run of a vehicle to or from the entrance and exit position is the slowest process. To bring a vehicle by self-run to the entrance and exit position, the passenger is required to drive the vehicle by self-propulsion to there, stop the engine, get out of the vehicle and leave the place. This also applies to the exit position, and in comparison with other processes such as vertical movement of the elevator, self-run of the vehicle to the entrance and exit position is the slowest process.

Entrance or exit of a vehicle is composed of three steps; self-run of the vehicle by the passenger to the entrance position or self-run of the vehicle from the exit position, vertical travel by the elevator, and travel by a power carrier on the parking floor. If these steps are carried out simultaneously, the speed of entrance and exit can be improved significantly. For simplicity, if all of these steps are assumed to take the same duration, the parallel operation wherein all of these three steps proceed simultaneously will raise the entrance and exit speed by about three times in comparison with the sequential execution of the three steps. In practice, the most time-consuming operation is the self-propulsion of the vehicle to or from the entrance and exit positions. Improvements in the entrance and exit speeds are particularly required when entrance and exit of a large number of vehicles are to be made in succession. Thus, when entrance and exit operations are required in succession, the entrance and exit speeds are improved by executing, in parallel, the three kinds of operations; entrance or exit operation of a vehicle to or from the entrance and exit area, vertical travelling operation of the elevator, and travelling operation of the power carriers.

Now, the entrance and exit area and the elevator are separated from each other so that the entrance and exit of vehicles to and from the entrance and exit area and the vertical travelling of the elevator can be executed in parallel with each other. Moreover, to achieve smooth transfer of a vehicle between the entrance and exit area and the elevator, and between the elevator and the power carriers, the entrance and exit area, elevator and power carriers are all provided with means for transferring a vehicle such as rollers; thus vehicles are transferred by the vehicle transferring means. Other than rollers, slat conveyors, push bars and the like may be used as the vehicle transferring means.

EMBODIMENT

Figure 1:
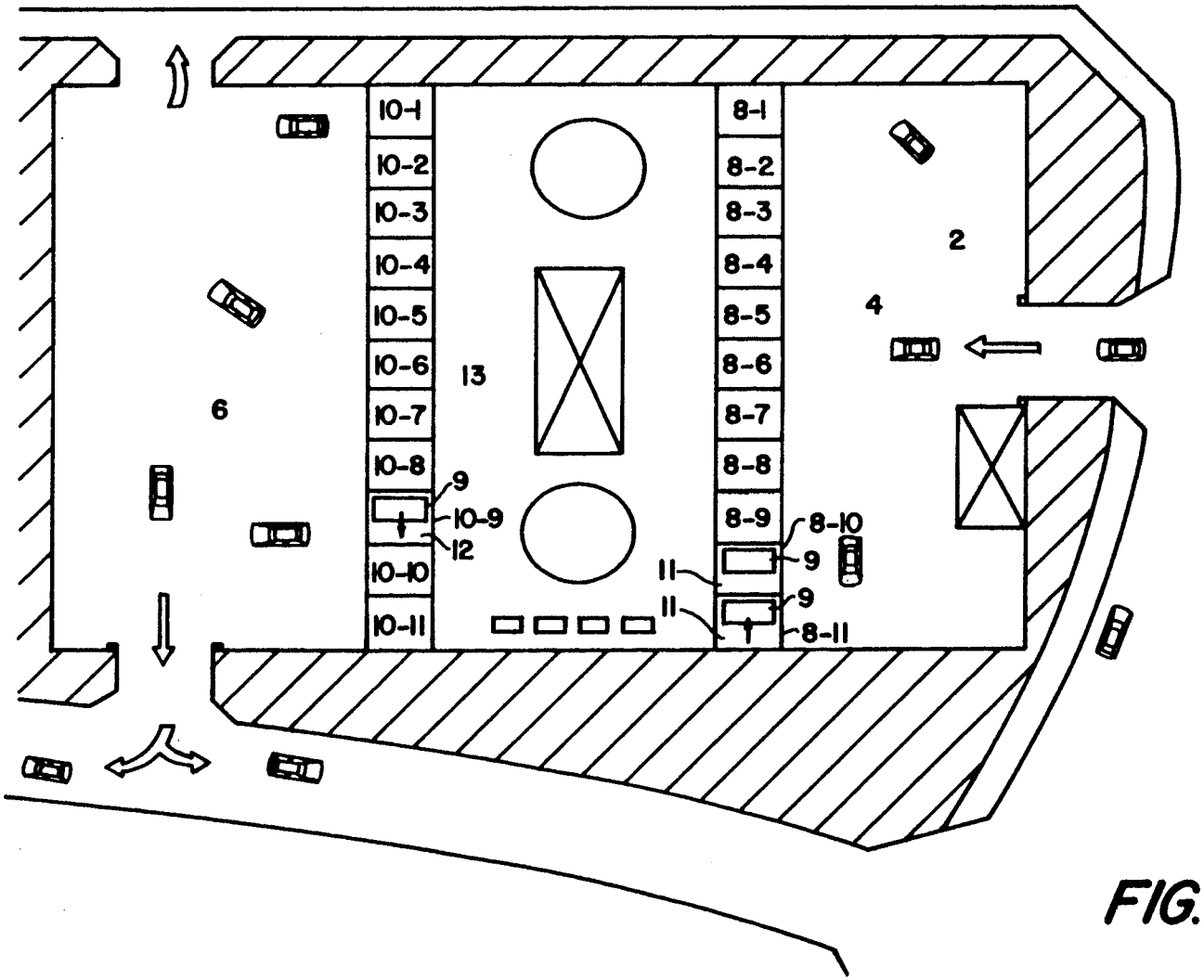
FIG. 1 is a plan view illustrating the entrance and exit floor of a multistory parking space according to an embodiment of the present invention.
Figure 2:
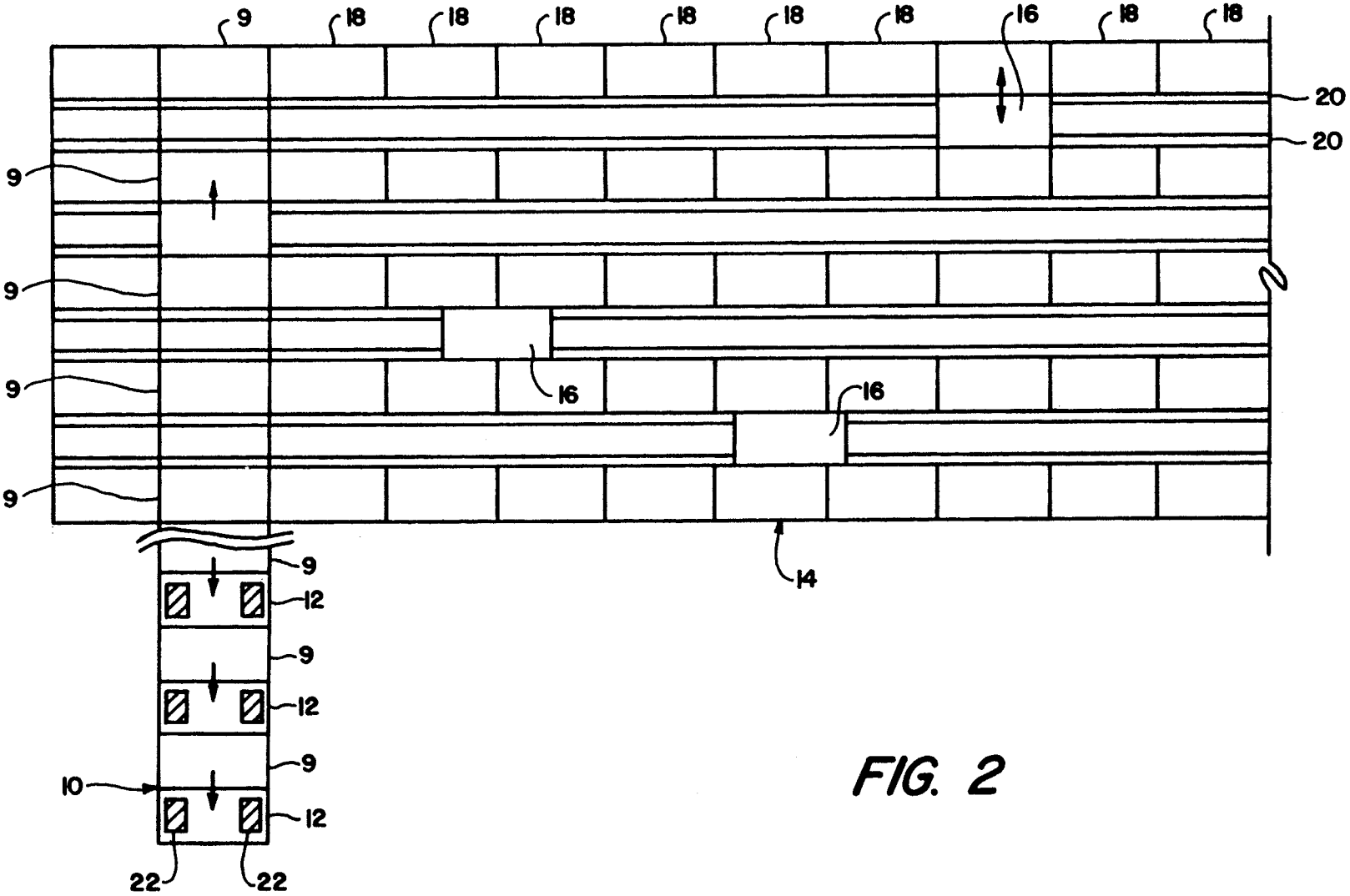
FIG. 2 is a plan view illustrating the parking floor of the multistory parking space according to the embodiment.

With reference to FIGS. 1 and 2, the overall structure of the multistory parking space will be explained. In FIG. 1, 2 denotes the building of the multistory parking space, 4 the entrance floor, and 6 the exit floor, respectively. It is possible not to separate the entrance floor 4 and the exit floor 6 from each other. One floor may be used for both entrance and exit. 8-1 through 8-11 denote sets of an elevator 9 for entrance and an entrance area 11. 10-1 through 10-11 similarly denote sets of an elevator 9 for exit and an exit area 12. The entrance area 11 and the exit area 12 are comprised of two power rollers provided to correspond to the front wheels and the rear wheels of vehicles, respectively. The elevator 9 is also provided with two power rollers for shifting a vehicle. Thus the transfer of a vehicle from the entrance area 11 to the elevator 9, and from the elevator 9 to the exit area 12 is effected by sliding the vehicle with power rollers. It is possible not to differentiate elevators for entrance from those for exit. The same elevator may be used for both purposes. Furthermore, the same area may serve as an entrance area 11 and an exit area 12. Moreover, two entrance areas 11 or two exit areas 12 may be provided on both sides of one elevator to enhance the handling capabilities of the entrance areas 11 or exit areas 12. 13 denotes the floor for pedestrians of the building, and the floor provides passage from the entrance floor 4 or to the exit floor 6 and gives access to a shopping center, office spaces, etc.

FIG. 2 is a plan view of the parking floor 14. The elevators 9 and exit areas 12 indicated in the lower part of the diagram are those of the exit floor 6. In the diagram, 16 denotes a power carrier for transporting a vehicle, and 18 denotes a parking pallet for a vehicle. The power carriers 16 and the parking pallets 18 are all provided with two power rollers, and the transfer of a vehicle between the power carrier 16 and the pallet 18 is effected by sliding motion caused by the power rollers. 20 denotes rails for travelling of the power carrier. The power carrier 16 runs by self-propulsion on the rails 20, using wheels not illustrated. The power carrier 16 is provided with a motor or motors not illustrated. Electric power from, for example, a power line provided separately from the rails 20 is used to operate the motor or motors, and in turn, to rotate the wheels; thus the power carrier 16 moves on the rails 20. The power carrier is to be controlled by control signals sent from a signal line not illustrated.

Figure 3:
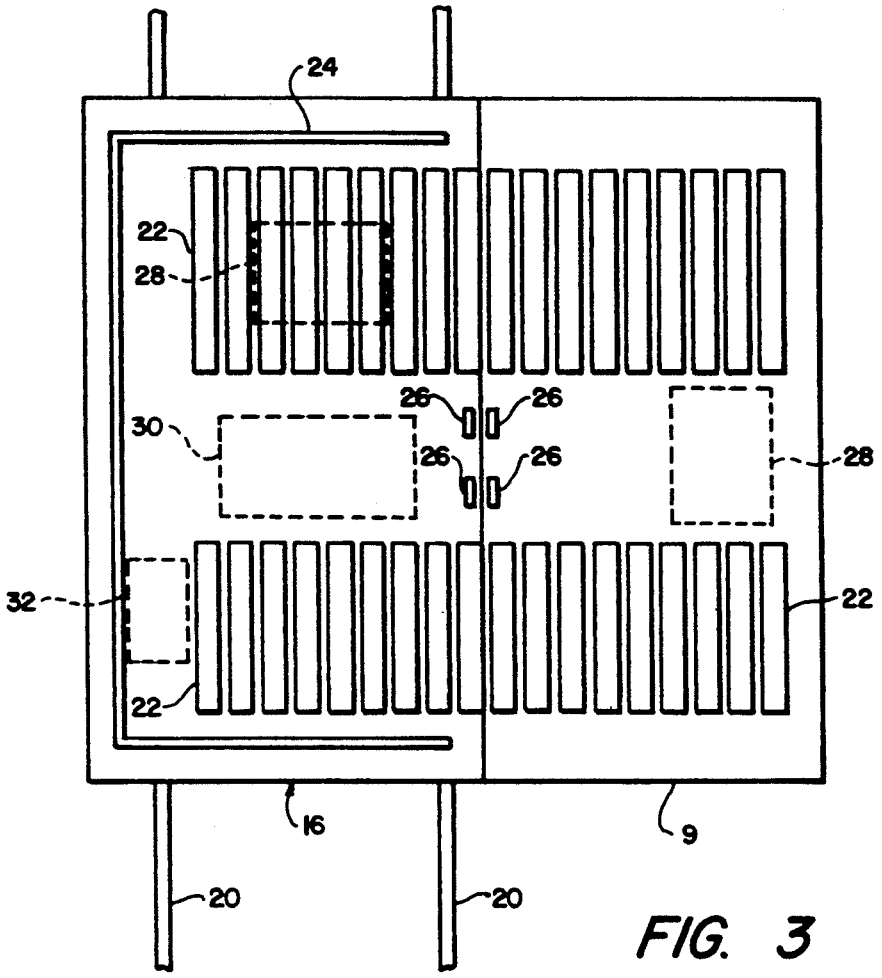
FIG. 3 is a plan view illustrating the vehicle exchange mechanism according to the embodiment.

FIG. 3 shows power rollers 22 as vehicle transferring means provided on the floors of the elevator 9 and of the power carrier 16. In the embodiment, transfers of a vehicle between the entrance area 11 and the elevator 9, between the exit area 12 and the elevator 9, between elevator 9 and the power carrier 16, and between the power carrier 16 and the parking pallet 18 are all effected by power rollers 22. Although not illustrated specifically, the entrance area 11, the exit area 12 and the parking pallet 18 are all provided with similar power rollers 22. The power rollers 22 correspond to the front wheels and the rear wheels of a vehicle, and the floors of the power carrier 16 and of the elevator 9 are provided with two power rollers 22, respectively. These power rollers 22 shift a vehicle by sliding it sideways. 24 denotes a bumping guard for fixing a vehicle to the power carrier 16. 26 denotes an ultrasonic wave sensor, etc. for detecting the transfer of a vehicle. The sensor 26 is used to verify that the transfer of a vehicle has been started and that the transfer Of the vehicle is completed. The power rollers 22 are here illustrated as power rollers for sliding sideways. This is to prevent the vehicle from sliding longitudinally relative to the power rollers 22. Naturally power rollers for longitudinal sliding may be used to shift the vehicle in the longitudinal direction thereof. In place of two power rollers corresponding to the front wheels and the rear wheels of the vehicle respectively, one single longitudinal power roller may be used to handle both the front wheels and the rear wheels.

28 denotes the motor for driving the power roller 22, and 30 denotes the motor for self-propulsion of the power carrier 16. 32 denotes the control circuit of the power carrier 16, and the control circuit is controlled by signals from a computer for centralized control not illustrated. The elevator 9, parking pallet 18, entrance area 11 and exit area 12 are all provided with a similar control circuit.

To drive the power carrier 16, in addition to those mentioned above, electric power source, signal lines connected to the computer for centralized control, and sensors for position, velocity, acceleration, etc. of the carrier 16 are used. With regard to such items, explanation will be given with reference to FIGS. 4 and 5.

Figure 4:
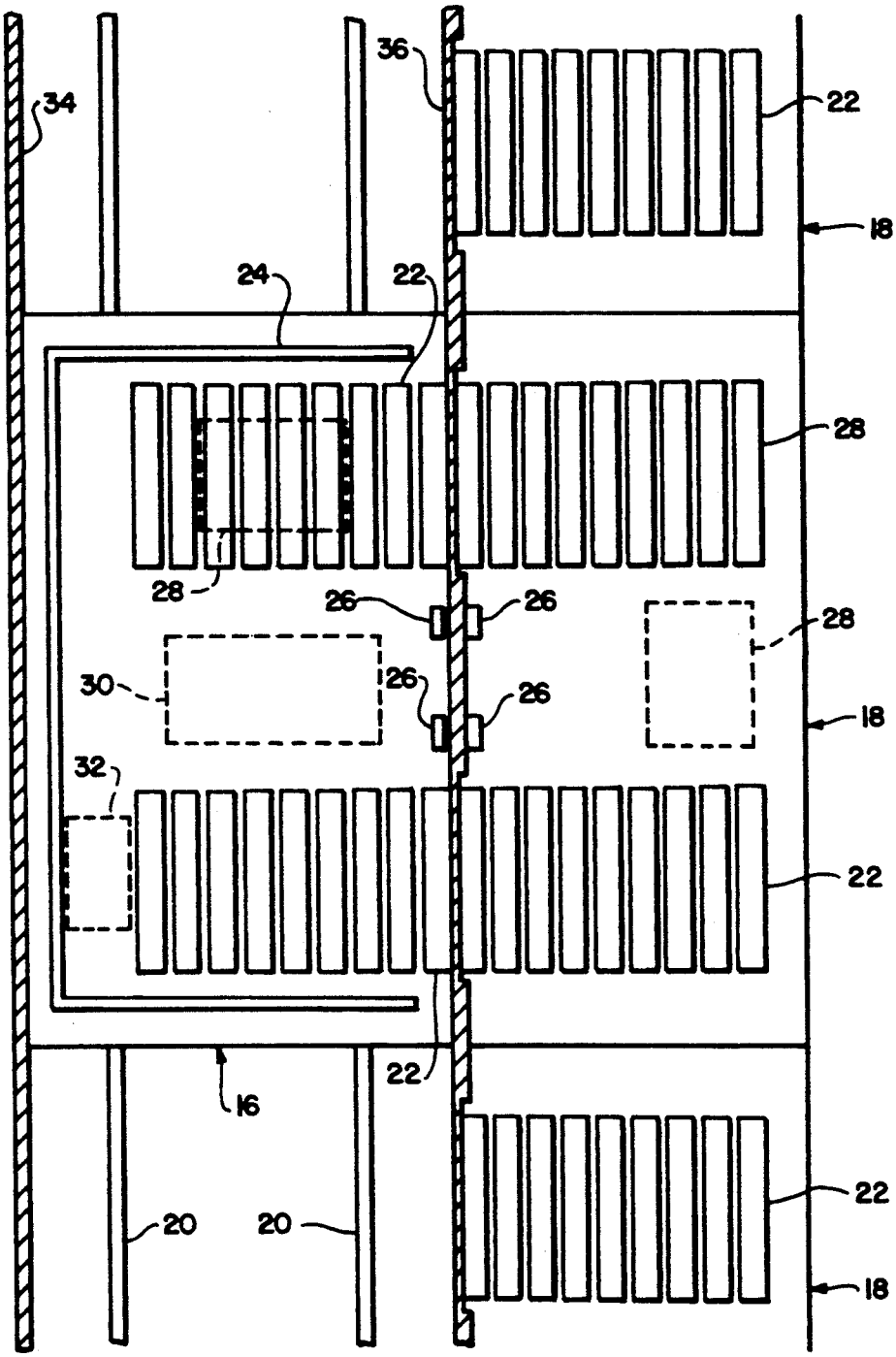
FIG. 4 is a partial plan view of the parking floor.

FIG. 4 indicates the arrangement of the power carrier 16 and parking pallets 18. Each parking pallet 18 is provided with power rollers 22 similar to those installed on the power carrier 16. The power rollers 22 are turned by the motors 28 to shift the vehicle, and the transfer of the vehicle is verified by the sensors 26. The parking pallets 18 are fixed to the floor 14 and do not move. In a similar manner, the entrance areas 11 and the exit areas 12 are provided with power rollers 22 or the like. as will be readily appreciated, the rollers 22, which serve as vehicle transfer means, transfer a vehicle by direct contact therewith. In other words, the rollers 22 directly contact the vehicle when transferring the vehicle. More specifically, the rollers 22 directly contact the tires of the vehicle. Moreover, the rollers 22 at the entrance areas 11 and exit areas 12 would remain at the entrance and exit areas when transferring a vehicle. 34 denotes the power line installed on the parking floor 14, and the power line supplies power to the power carrier 16. 36 denotes the signal line connected to the computer for centralized control.

Figure 5:
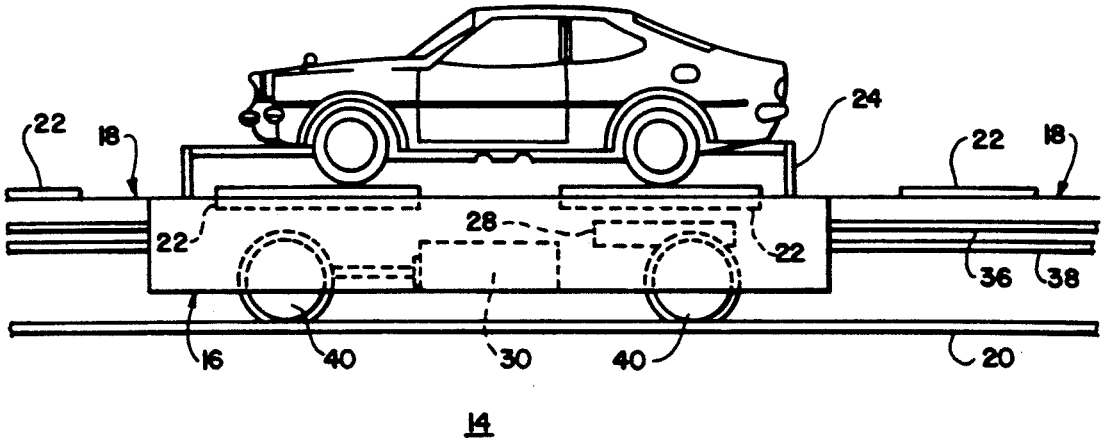
FIG. 5 is a side view of the parking floor.

FIG. 5 is a side view of the power carrier 16. 40 denotes the wheel, and the wheels are driven by the motor 30 to effect self-propulsion of the power carrier 16 on the rails 20. The power rollers 22 are rotated by the motor 28. 38 denotes position sensors arranged linearly for confirming the position of the power carrier 16. In addition to such sensors, the power carrier 16 are provided with velocity sensors and acceleration sensors so that the position, velocity and acceleration of the power carrier 16 can be detected at any time.

Now the operation of the facilities will be explained. A vehicle that has entered the entrance floor 4 runs by self-run into an entrance area 11, and the passenger leaves the vehicle therein. The following entrance operation will be made automatically, and the passenger may use the passage not illustrated to enter a shopping center, etc. inside the building. In the case of exit, the passenger uses the pedestrian passage 13 and gets into the vehicle inside an exit area 12, and drives the vehicle under self-run to leave the floor 6. In the embodiment, as the direction of the vehicle is not reversed, the vehicle that entered the floor 4 will be shifted onto the floor 6 in the same orientation. When the entrance floor 5 and the exit floor 6 are separated from each other, the stream of the entering vehicles and the stream of the exiting vehicles will not congest with each other. If a pedestrian passage 13 is provided between the two floors, the stream of persons will be natural and smooth.

The vehicle 11 standing in the entrance area 11 will be shifted into the elevator 9 by the power rollers 22. When the elevator 9 reaches the parking floor 14, the vehicle will be shifted again by the power rollers 22 onto a power carrier 16. The entrance of the vehicle into the entrance area 11 and the travel of the elevator 9 are made in parallel at the same time to reduce the waiting duration. The travel of the elevator 9 to the parking floor 14 and the travel of the power carrier 16 are made at the same time to reduce the time required for the travel of the vehicle.

The power carrier 16 that has received the vehicle will effect self-propulsion on the rails 20 by means of the motor 30. With this arrangement, the travelling speed of the power carrier 16 can be increased significantly. For instance, suppose the power carrier 16 is to be moved by rollers or chains in place of the rails 20. With rollers or chains, the power carrier 16 cannot be moved at a high speed. Rollers having a small diameter can not raise the speed of the power carrier 16, and if the diameter is made larger, the power carrier 16 will experience larger vibration. Chains or gears can not achieve high speed travel of the power carrier 16. Hence the rails 20 are used to achieve high speed travel of the carrier 16 through self-propulsion. Furthermore, when rollers or chains are used, a power plant must be installed all over the parking floor 14, resulting in a higher equipment cost.

When the power carrier 16 reaches the specified parking pallet 18 and stops, the vehicle will be shifted onto the parking pallet 18 by the power rollers 22. To control the travel of the carrier 16, the position sensors, velocity sensors, and acceleration sensors are used, and the control is given by the computer for centralized control.

Other than such arrangements, the present inventor examined an alternative approach wherein the vehicle is fixed onto the pallet and the vehicle is shifted together with the pallet rather than shifting the vehicle by rollers. This approach, however, will force the elevator 9 and the power carrier 16 to make redundant reciprocating travels, and in turn, lower the performance of the multistory parking space. For instance, suppose a vehicle be shifted from the elevator 9 to the power carrier 16. If the elevator 9 and the power carrier 16 do not use one pallet in common, the power carrier 16 must receive an empty pallet in another location before receiving the vehicle. On the other hand, when the vehicle is to be shifted from the power carrier 16 to the elevator 9, the power carrier 16 must return the empty pallet, after shifting the vehicle, to the original position before starting the following exit operation. As a result, the power carrier 16 must transport an empty pallet for every transport of a vehicle. Thus the efficiency of the power carrier 16 will be reduced to one half.

Next, let us consider an approach wherein the vehicle and the parking pallet are handled as a complete set. In this case, when the vehicle is transferred between the elevator 9 and the power carrier 16, the vehicle is moved together with the pallet. For entrance of the vehicle, first an empty pallet is carried by the power carrier 16 and loaded into the elevator 9. Next entrance of the vehicle will be made after the elevator 9 completes its vertical travel to the entrance floor 4. To make the next entrance operation, another empty pallet must be similarly loaded into the elevator 9 beforehand. In the case of exit, the empty pallet will be left in the elevator after the vehicle drives away. The following exit operation can be started only after the empty pallet has been restored in the original position by using the power carrier 16.

Accordingly, the pallets 18 are fixed on the parking floor 14 and only vehicles are transferred by the power rollers 22 to eliminate the problems related to the transfer of the pallets.

When the power carrier 16 is arranged to run on the rails 20 under self-propulsion to raise the travel speed and the pallets are fixed to eliminate redundant reciprocating travels, the vehicle's speed of entrance into and exit from the elevator 9 will determine the operation speed. It is because these operations must rely on the self-propulsion of the vehicle under the control of the passenger, and such operations are the slowest ones. Hence the entrance area 11 and exit area 12 are separated from the elevator 9 so that in parallel with the vertical movement of the elevator 9, a vehicle can come to stand in the entrance area 1 or depart from the exit area 12.

Figure 6:
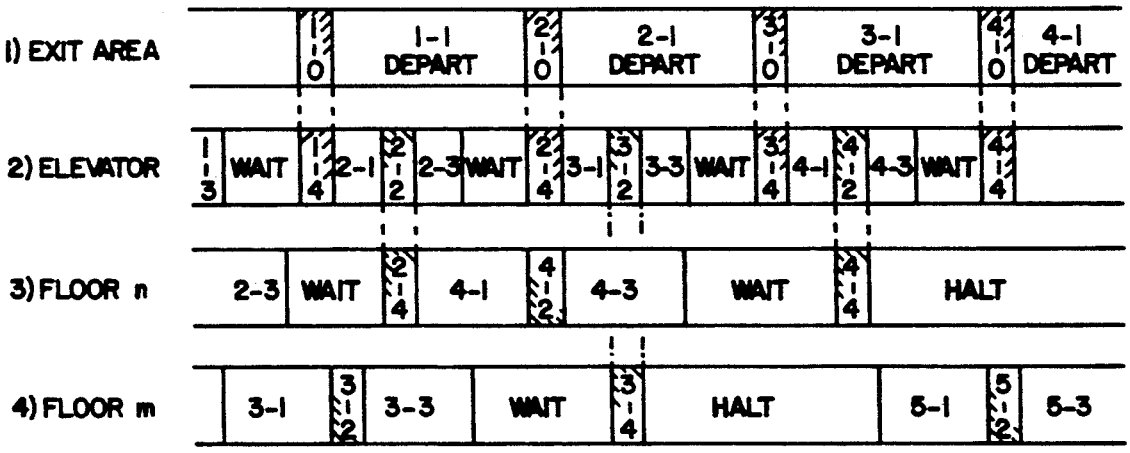
FIG. 6 is an operation chart of the multistory parking space according to the embodiment.
Figure 7:
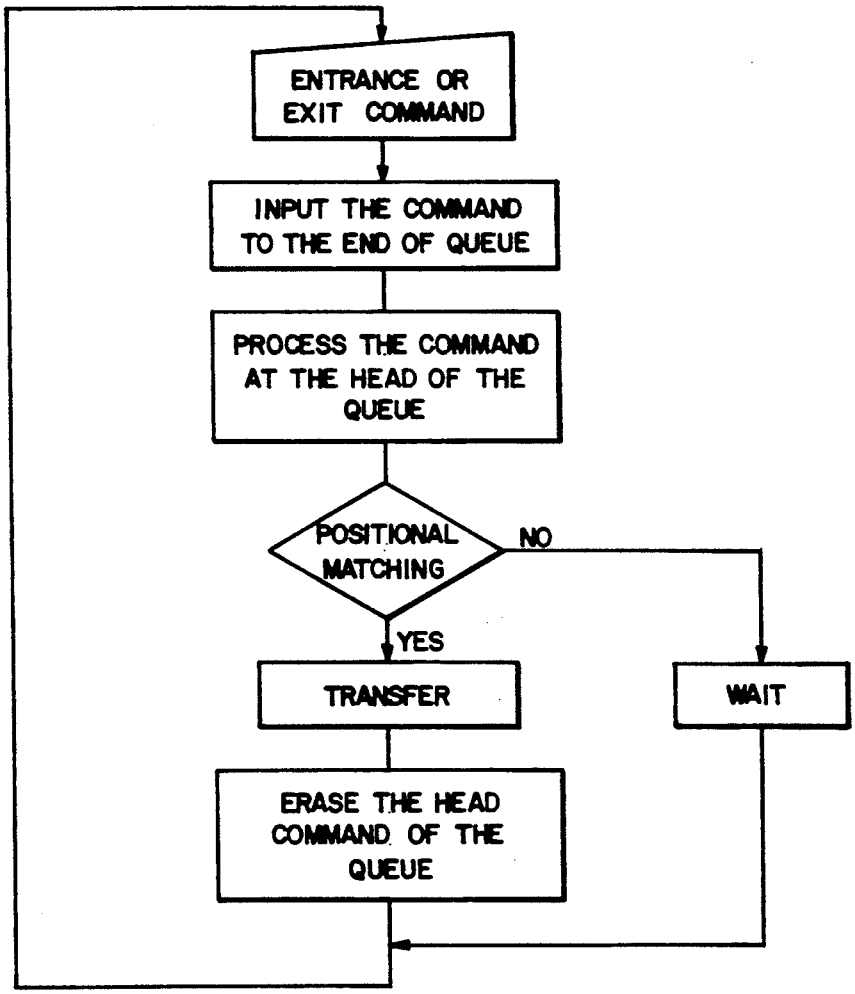
FIG. 7 is a flowchart illustrating the operation algorithm of the embodiment.

FIG. 6 shows the operation mode of the embodiment by taking the case of continuous entrance and exit of vehicles as an example. FIG. 7 shows the operation algorithm of the embodiment. When entrance and exit of vehicles are made with enough time intervals, the operation is simple. Its explanation is omitted here since it will be clearly understood from the following operation.

Of the symbols such as 2-1 in FIG. 6, 2 at the head is the number of the vehicle being handled, and 1 of the latter half indicates a process of the operation cycle. For the exit area 12, the process 0 is the transfer of the vehicle from the elevator 9 to the exit area 12, and the process 1 is the self-run of the vehicle under the control of the passenger. For the elevator 9, the process 1 is the movement of the elevator 9 to the parking floor 14, and the process 2 is the transfer of the vehicle from the power carrier 16 to the elevator 9, and the process 3 is the movement of the elevator 9 to the exit floor 6. The process 4 is the transfer of the vehicle from the elevator 9 to the exit area 12. For the parking floor 14, the process 1 is the travel of the power carrier 16 to the parking pallet 18, the process 2 is the transfer of the vehicle from the parking pallet 18 to the power carrier 16, the process 3 is the travel of the power carrier 16 to the position in front of the elevator 9, and the process 4 is the transfer of the vehicle from the power carrier 16 to the elevator 9.

Suppose continuous exit of vehicles is required. In the embodiment, the shutter of the elevator 9 will open just when the exit area 12 becomes vacant, and a vehicle will be transferred from the elevator 9 to the exit area 12 by means of the power rollers 22. This operation is made only after two conditions have been met; the completion of the movement of the elevator 9 and the vacancy of the exit area 12. As the exit by self-run of the vehicle is the slowest process, the elevator has to wait on the exit floor 6 in many cases. As a result, the next vehicle will arrive just when the exit of the preceding vehicle is completed. The stoppage and start of the vehicle is made in the spacious exit area 12 and entrance area 11 rather than in the narrow space inside the elevator 9. Hence the sense of oppression experienced by the passenger is lower, and the wider space allows easier stoppage and start.

When the process of shifting the vehicle with the power rollers 22 is completed, the passenger will get into the vehicle, and the vehicle will depart. At the same time, the elevator 9 will move to the next parking floor. On the other hand, independently of the aforementioned process, the relevant power carrier 16 will transport the specified vehicle to the position in front of the elevator 9. In other words, the power carrier 16 will travel to a desired parking pallet 18, and a vehicle will be loaded from the parking pallet 18 onto the power carrier 16 by the power rollers 22. Then the power carrier 16 will travel to the position in front of the elevator 9. The power carrier 16 will wait for the arrival of the elevator 9, or when the travel of the power carrier 16 is slow, the elevator 9 will wait for the arrival of the power carrier 16 to shift the vehicle by means of the power rollers 22. The vertical movement of the elevator 9 and the travel of the power carrier 16 are made simultaneously.

After that, the elevator 9 will move to the exit floor 6. The elevator 9 will wait till the exit area 12 becomes vacant, and then transfer the vehicle. Of these operations, synchronization is required for two operations; the transfer of the vehicle between the elevator 9 and the entrance area 11 or the exit area 12, and transfer of the vehicle between the elevator 9 and the power carrier 16. To meet this requirement, it is sufficient to make the actions of the respective elements, the entrance area 11, exit area 12, elevator 9 and power carrier 16 simultaneously, and allocate required waiting durations according to the actions of slower elements. Although the case of exit was explained above, a similar approach is also applicable to entrance. Stoppage of the vehicle in the entrance area 11 and exit of the passenger, the travel of the elevator 9, and the travel of the power carrier 16 on the parking floor are made simultaneously.

Now the process durations of the entrance and exit will be discussed. In the case of continuous entrance and exit, the slowest processes are normally the entry of the vehicle under self-propulsion and stoppage in the entrance area 11, and the departure of the vehicle under self-propulsion from the exit area 12. Hence the handling of the next vehicle can be started just when the preceding vehicle completes the self-propulsion into the entrance area or when the preceding vehicle completes the self-propulsion from the exit area. When entrance of vehicles are made with enough intervals, the elevator 9 is ready at the entrance area 11. Hence the transfer of the vehicle into the elevator 9 by the power rollers will be started just when the entry of the vehicle under self-run into the entrance area 11 is completed. When exit of vehicles is made intermittently, in concurrence with the travel of the elevator 9 to the parking floor 14, the power carrier 16 transports the desired vehicle to the position in front of the elevator 9. As a result, the required duration is virtually no more than the duration required for the reciprocating movements of the elevator 9.

The algorithm of FIG. 7 will be explained. When a command of entrance or exit is received, the respective elements, elevator 9, entrance area 11, exit area 12 and power carrier 16 will input the new command to the end of their queues. Each element processes the queue, beginning with the command at the head of the queue. When the matter of the element's charge is executed, the element will erase the command at the head of the queue and start to process the next command in the queue. The speeds and loads of the respective elements are varied. The loads of the entrance area 11 and exit area 12 are the highest. The load of the elevator 9 comes next to them, and the load of the power carrier is low. Accordingly, the transfer of the vehicle is made after the preparation of the counterpart to which the vehicle is transferred is completed (this is referred to as "positional matching" in FIG. 7). When the positional matching condition is not met, the element that completes the process first will come into the waiting state. When the transfer is completed, each element that completed the operation will process the next command in the queue. Elements that have not received any commands (for example, the power carrier 16 of a floor to which an entrance or exit command has not been given) will come into the resting state.

What is claimed is:

1. A multistory parking space comprising:

an entrance and exit floor adapted to allow vehicles to enter and exit from said multistory parking space;

at least one parking floor further comprising a plurality of stationary parking pallets having lower surfaces and at least one power carrier, wherein said power carrier and each of said plurality of parking pallets is adapted to receive at least one vehicle thereon, and wherein said at least one power carrier has a motor and wheels attached thereto, said motor and wheels being operatively coupled, said parking floor further having rail means for engaging said power carrier wheels whereby said at least one power carrier is capable of being driven along said rail means by said motor and said wheels coupled to said motor to positions adjacent said plurality of pallets;

at least one elevator means extending between said entrance and exit floor and said at least one parking floor for moving vehicles between said floors, said elevator means being adapted to receive at least one vehicle thereon, and wherein said entrance and exit floor has at least one entrance and exit area adjacent to said at least one elevator means;

vehicle transfer means provided on said at least one power carrier for transferring a vehicle, by direct contact therewith, disposed on said carrier to a parking pallet by shifting motion and to said elevator means, and wherein said vehicle transfer means at said at least one power carrier remains at said at least one power carrier when transferring a vehicle;

vehicle transfer means provided on each of said plurality of parking pallets for transferring vehicles, by direct contact therewith, disposed on said pallets to said at least one power carrier, and wherein said vehicle transfer means on each of said plurality of parking pallets remains on each of said plurality of parking pallets when transferring a vehicle; and vehicle transfer means provided on said elevator means for transferring a vehicle, by direct contact therewith, disposed on said elevator means to said entrance and exit area and to said at least one power carrier, and wherein said vehicle transfer means on said elevator means remains on said elevator means when transferring a vehicle; and vehicle transfer means provided at said entrance and exit area for transferring a vehicle, by direct contact therewith, disposed at said area to said elevator means, and wherein said vehicle transfer means at said entrance and exit area remains at said entrance and exit area when transferring a vehicle.

2. A multistory parking space as recited in claim 1, further comprising:

means for simultaneously effecting three kinds of operations consisting of a movement of vehicles to and from said entrance and exit area on said entrance and exit floor by the self-propulsion of vehicles, a vertical travelling operation of vehicles by the elevator means, and a travelling operation of vehicles by said at least one power carrier.

3. A multistory parking space as recited in claim 2, wherein said entrance and exit area comprises a first area dedicated to entrance and a second area dedicated to exit, and wherein said elevator means comprises a first and a second elevator, said first elevator being dedicated to entrance operations and said second elevator being dedicated to exit operations, and wherein said first area dedicated to entrance is positioned adjacent said first elevator and said second area dedicated to exit operations is positioned adjacent said second elevator.

* * * * *